US008833340B2

(12) United States Patent
Walters

(10) Patent No.: US 8,833,340 B2
(45) Date of Patent: Sep. 16, 2014

(54) FLOATING ENGINE TIMING PLATE

(75) Inventor: Steven K. Walters, Marysville, OH (US)

(73) Assignee: Honda Motor Co., Ltd., Tokyo (JP)

( * ) Notice: Subject to any disclaimer, the term of this patent is extended or adjusted under 35 U.S.C. 154(b) by 310 days.

(21) Appl. No.: 13/167,218

(22) Filed: Jun. 23, 2011

(65) Prior Publication Data

US 2012/0325178 A1 Dec. 27, 2012

(51) Int. Cl.
*F02P 7/06* (2006.01)
*F02B 77/08* (2006.01)

(52) U.S. Cl.
CPC .. *F02B 77/08* (2013.01); *F02P 7/06* (2013.01)
USPC ..... 123/406.58

(58) Field of Classification Search
CPC ..... F02P 5/00; F02P 7/06; F02P 7/061; F02P 7/067; F02P 7/0672; F02P 7/0675; F02P 7/0677; F02P 7/07; F02P 7/0673
USPC ..... 123/197.4, 406.58
See application file for complete search history.

(56) References Cited

U.S. PATENT DOCUMENTS

| | | | | |
|---|---|---|---|---|
| 5,315,963 | A * | 5/1994 | Warf | 123/190.12 |
| 6,415,758 | B1 * | 7/2002 | Pierro et al. | 123/195 R |
| 7,055,243 | B2 | 6/2006 | Hodjat et al. | |
| 2008/0074105 | A1 | 3/2008 | Morita | |
| 2011/0067655 | A1 * | 3/2011 | Ottersbach et al. | 123/90.15 |

FOREIGN PATENT DOCUMENTS

| | | |
|---|---|---|
| JP | 2003172168 | 6/2003 |
| JP | 2006064066 | 3/2006 |
| WO | 2008093656 | 8/2008 |

OTHER PUBLICATIONS

Ford Engine Diagrams: 54USEM-E-5.4L 3V V8 (Jul. 2008) http://www.wholesalefordparts.com/showAssembly.aspx?ukey_assembly=1141126 http://www.wholesalefordparts.com/showAssembly.aspx?ukey_assembly=1132523 http://www.wholesalefordparts.com/showAssembly.aspx?ukey_assembly=1127273 39SDEM-A-3.9L Dohc EFI NA V8 Gas*HP (Mar. 1999) http://www.wholesalefordparts.com/showAssembly.aspx?ukey_product=9794161&ukey_assembly=1140675.*

Ford Engine Diagrams: 54USEM-E-5.4L 3V V8 (Jul. 2008) http://www.wholesalefordparts.com/showAssembly.aspx?ukey_assembly=1141126 http://www.wholesalefordparts.com/showAssembly.aspx?ukey_assembly=1132523 http://www.wholesalefordparts.com/showAssembly.aspx?ukey_assembly=1127273, 39SDEM-A-3.9L Dohc EFI NA V8 Gas HP (Mar. 1999) http://www.wholesalefordparts.com/showAssembly.aspx?ukey_product=9794161&ukey_assembly=1140675.*

Autozone Repair Guide: Dodge Sprinter, Timing Chain and Sprockets (2005-2007 model years) http://www.autozone.com/autozone/repairguides/Sprinter-2005-2007/Engine-Mechanical-Components/Timing-Chain-Sprockets/__/P-0996b43f8075b7c5.*

* cited by examiner

*Primary Examiner* — Lindsay Low
*Assistant Examiner* — Jacob Amick
(74) *Attorney, Agent, or Firm* — Plumsea Law Group, LLC

(57) ABSTRACT

An engine timing plate is disclosed that is generally positioned between a crankshaft surface and a main journal. The engine timing plate is not bolted or otherwise secured to either the crankshaft surface or the main journal. Instead, the timing plate "floats" between the two surfaces. The timing plate includes protruding portion that mates or temporarily associates with a receiving portion disposed on the crankshaft. The timing plate also generally includes a raised surface forming an integrated thrust surface that may engage with, but not necessarily interlock with, one or both of the crankshaft surface and the main journal. Thus, the rotational motion of the crankshaft maintains the relative position of the timing plate with respect to the crankshaft surface and/or the main journal without the use of standard mechanical connectors, such as bolts.

24 Claims, 12 Drawing Sheets

FLOATING ENGINE TIMING PLATE

BACKGROUND

The present invention relates generally to the field of engines, and more particularly, to a timing plate for use with a crankshaft.

Conventional timing plates are used in association with crankshafts to monitor crank angle. Conventional timing plates are often affixed to some portion of the crankshaft and rotate with the crankshaft. A crank angle sensor monitors the timing plate and thereby monitors the rotation, and crank angle, of the crankshaft.

Some conventional timing plates are bolted onto a portion of the crankshaft. For example, International Publication Number WO 2008/093656 shows a conventional timing plate bolted to a portion of a crankshaft journal. The bolt affixes the conventional timing plate to the crankshaft and ensures the conventional timing plate will rotate with the crankshaft.

Using bolts to affix the conventional timing plate to the crankshaft, however, adds mass to the crankshaft. The additional mass of the bolts must also be accounted for when statically and dynamically balancing the crankshaft.

There exists a need in the art for a timing plate that reduces the need for additional mass to be added to the mass of the crankshaft.

SUMMARY

In one aspect, the invention provides an engine comprising: a crankshaft connected to at least one piston by a connecting rod, the crankshaft configured to rotate about a crankshaft axis; the crankshaft including a first axial portion that lies on the crankshaft axis and is substantially symmetric about the crankshaft axis; a timing plate having a central hole and a plurality of indicia on a periphery portion of the timing plate; the timing plate including at least one protruding portion extending in a direction along the crankshaft axis; wherein first axial portion of the crankshaft extends through the central hole of the timing plate; wherein the crankshaft includes at least one receiving portion configured to receive the at least one protruding portion; and wherein the timing plate is configured to move along the crankshaft axis.

In another aspect, the invention provides an engine comprising: a crankshaft connected to at least one piston via a connecting rod, the crankshaft being configured to rotate about a crankshaft axis; and a timing plate having a central hole and a plurality of indicia on a periphery portion of the timing plate, wherein: the crankshaft includes a first axial component that lies on the crankshaft axis and is substantially symmetric about the crankshaft axis, the first axial component of the crankshaft extends through the central hole of the timing plate, the timing plate includes at least one protruding portion extending in a direction along the crankshaft axis, the crankshaft includes at least one receiving portion configured to receive the at least one protruding portion, the protruding portion and the receiving portion are removably mated, the timing plate and the crankshaft rotate with substantially the same speed, and the timing plate floats about the first axial component when the timing plate and the crankshaft rotate.

In another aspect, the invention provides an engine comprising: a crankshaft connected to at least one piston via a connecting rod, the crankshaft being configured to rotate about a crankshaft axis; and a timing plate having a central hole and a plurality of indicia, wherein: the timing plate has at least one protruding portion extending in a direction along the crankshaft axis, the crankshaft has at least one receiving portion configured to receive the at least one protruding portion, the timing plate and the crankshaft rotate with substantially the same speed, and the timing plate is associated with the crankshaft via a connecting system, the connecting system consisting essentially of the at least one protruding portion being received by the at least one receiving portion.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
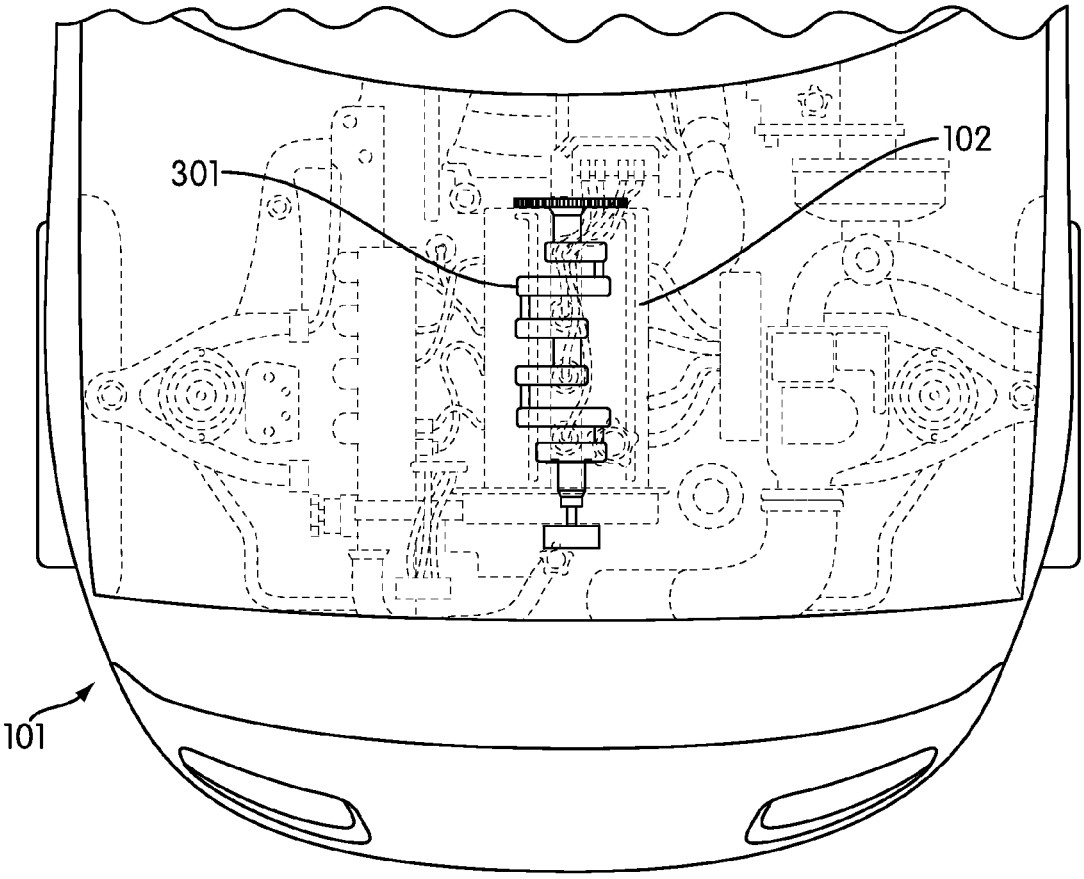
FIG. 1 is a top view of an engine of a motor vehicle.

FIG. 1 illustrates a front region of an embodiment of a motor vehicle 101. Motor vehicle 101 may be any type of motor vehicle known in the art. The term "motor vehicle" as used throughout this specification and claims refers to any moving vehicle that is capable of carrying one or more human occupants and is powered by any form of energy. The term "motor vehicle" includes, but is not limited to: cars, trucks, vans, minivans, SUVs, motorcycles, scooters, boats, personal watercraft, and aircraft.

In some embodiments, motor vehicle 101 may include one or more engines. The term "engine" as used throughout this specification and claims refers to any device or machine that is capable of converting energy. In some cases, potential energy is converted to kinetic energy. For example, energy conversion may include a situation where the chemical potential energy of a fuel or fuel cell is converted into rotational kinetic energy or where electrical potential energy is converted into rotational kinetic energy. Engines may also include provisions for converting kinetic energy into potential energy. For example, some engines include regenerative braking systems where kinetic energy from a drive train is converted into potential energy. Engines may also include devices that convert solar or nuclear energy into another form of energy. Some examples of engines include, but are not limited to: internal combustion engines, electric motors, solar energy converters, turbines, nuclear power plants, and hybrid systems that combine two or more different types of energy conversion processes.

In this embodiment, motor vehicle 101 may include an engine 102. In an exemplary embodiment, engine 102 may be an internal combustion engine. In some cases, engine 102 may be a piston engine including any number of cylinders. In other cases, engine 102 may be a rotary engine. In other embodiments, engine 102 may be an electric motor. In still other embodiments, engine 102 may be any type of engine, as discussed above. In some embodiments, motor vehicle 101 and engine 102 may be further associated with additional components, including, but not limited to a power train system, as well as other components necessary for a motor vehicle to operate.

In some embodiments, engine 102 may include a number of pistons associated with one or more cylinders. In an exemplary embodiment, engine 102 may include a single piston for each cylinder. The plurality of pistons and corresponding cylinders may be of any type of piston and/or cylinders known in the art. In some embodiments, the plurality of pistons and cylinders may be arranged in a V-shaped configuration within engine 102. In other embodiments, the plurality of pistons and cylinders may be arranged within engine 102 in an inline or straight configuration. In different embodiments, the plurality of pistons and cylinders may be arranged within engine 102 in any arrangement known in the art.

In some embodiments, fuel may be injected into the cylinders and may be ignited to create pressure in the cylinders. The pressure in the cylinders may cause the pistons associated with the cylinders to move. In some cases, the movement of the pistons may be a reciprocating motion.

In some embodiments, engine 102 may include a crankshaft 301. Crankshaft 301 may be any type of crankshaft known in the art. In an exemplary embodiment, crankshaft 301 may be associated with the plurality of pistons via a plurality of connecting rods. In one embodiment, the plurality of connecting rods may connect the plurality of pistons to crankshaft 301. Crankshaft 301 may translate a reciprocating motion of the plurality of pistons into rotational motion.

Generally, the timing of the firing to ignite fuel in the cylinders, the motion of the pistons, and the rotation of crankshaft 301 may be synchronized, such as with a timing belt, gear, or chain.

Figure 2:
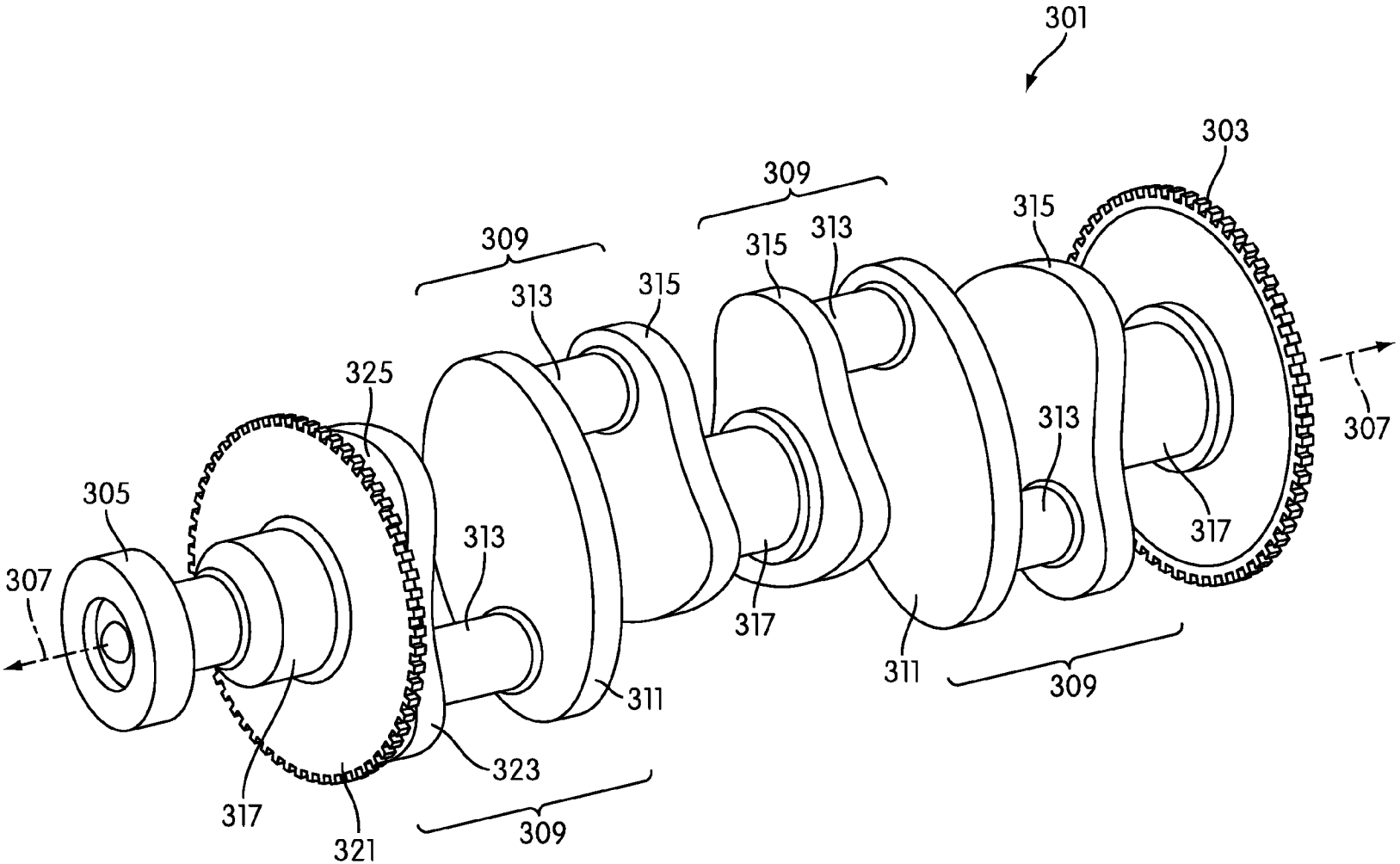
FIG. 2 is an isometric view of an exemplary embodiment of a crankshaft.
Figure 3:
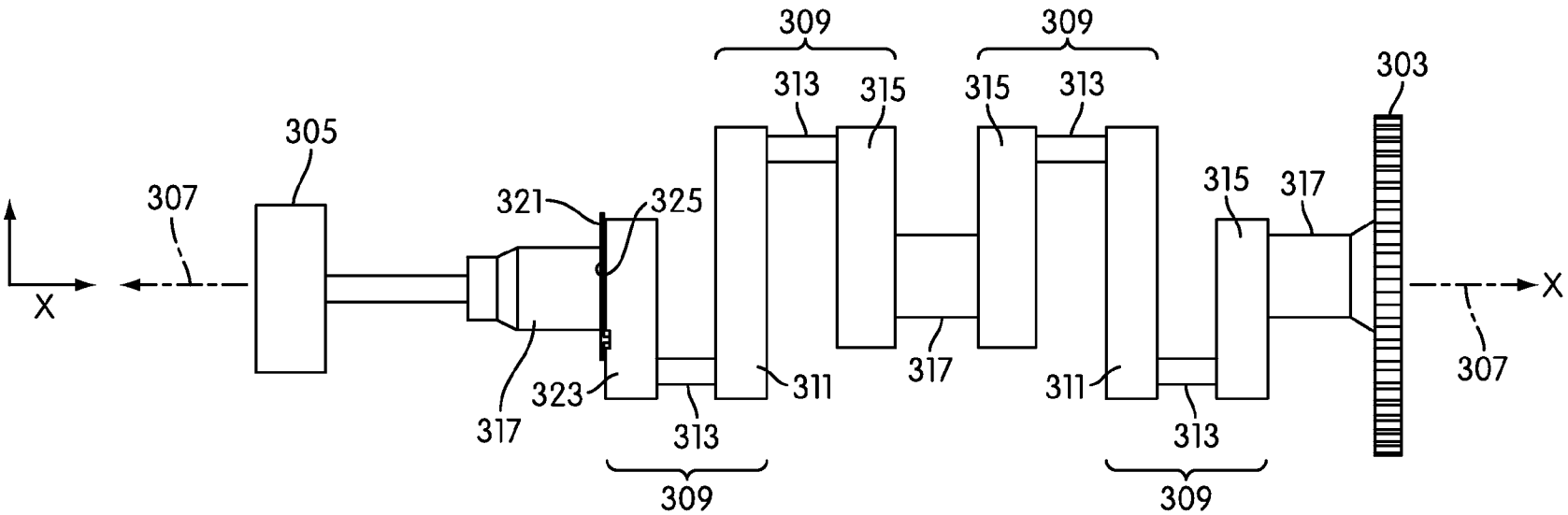
FIG. 3 is a side view of an exemplary embodiment of a crankshaft.

FIGS. 2 and 3 illustrate an exemplary embodiment of crankshaft 301. In some embodiments, crankshaft 301 may be associated with one or more components. In one embodiment, crankshaft 301 may include a flywheel 303, a damper 305, a plurality of crankshaft journals 309, a plurality of main bearing journals 317, and a timing plate 321. In some embodiments, crankshaft 301 may define a crankshaft axis 307 along the length of crankshaft 301. For convenience, throughout this description the term "flywheel side" refers to positions proximate to a flywheel, including flywheel 303. Similarly, the term "damper side" refers to a side closer to a damper on crankshaft 301, including damper 305. For example, a damper side of timing plate 321 is visible in FIG. 2. Crankshaft 301 may generally be considered to extend from a flywheel side to a damper side.

For consistency and convenience, directional adjectives are employed throughout this detailed description corresponding to the illustrated embodiments. The term "axial," as used throughout this detailed description, refers to a direction along an axis defined by crankshaft axis 307. The term "radial," as used throughout this detailed description, refers to any direction extending radially outward from crankshaft axis 307.

Generally, crankshaft 301 may have a mass that is substantially the sum of the masses of each component included with crankshaft 301. In some cases, the components of crankshaft 301 may have irregular shapes and, therefore, uneven distributions of mass. Designers of crankshaft 301 may strive to balance the mass of crankshaft 301, for example, to reduce vibrations, bending of crankshaft 301, wear and tear on the bearing and journal surfaces, and other typically undesirable effects. The balancing of the mass of crankshaft 301 is often done both statically, i.e., when crankshaft 301 is not moving, and dynamically, i.e., when crankshaft 301 is rotating.

Crankshaft static balance, as generally understood in the art, may be achieved by equally distributing a mass of crankshaft 301 around crankshaft axis 307. In some cases, any crankshaft element spaced radially from crankshaft axis 307 may be balanced by another crankshaft element of substantially equal mass on a radially opposite side of crankshaft axis 307. A statically balanced crankshaft at rest is intended to remain at rest and not rotate unless acted on by an outside force.

Crankshaft dynamic balance, as generally understood in the art, may be achieved by balancing all centrifugal forces at every point acting on crankshaft 301, during rotation of crankshaft 301 around crankshaft axis 307. Crankshaft dynamic balance may prevent unequal forces from acting on any portion of crankshaft 301 during rotation. Additionally, crankshaft dynamic balance may prevent vibration in crankshaft 301 during rotation.

In some embodiments, statically and dynamically balancing crankshaft 301 may be achieved by balancing every mass located on crankshaft 301 against another substantially similar mass. In some cases, statically and dynamically balancing crankshaft 301 may be a time consuming and expensive process. In some embodiments, removing components from crankshaft 301 may reduce the mass of crankshaft 301 and ease the balancing process. Accordingly, eliminating various crankshaft components, or combining multiple components into a single component without reducing the functionality of crankshaft 301, may assist with the balancing process.

In the various embodiments discussed herein, timing plate 321 may be provided to float between crankshaft components to assist in the balancing process by eliminating a mechanical connector, such as a bolt, typically used to attach a timing plate to the adjacent crankshaft components. Prior to discussing the details of timing plate 321, a general discussion of typical crankshaft components is set forth below.

In some embodiments, crankshaft 301 may include components configured to reduce vibrations or other characteristics associated with the reciprocating motion of the plurality of pistons. In one embodiment, crankshaft 301 may include flywheel 303. In some embodiments, flywheel 303 may store rotational energy to provide a smother engine rotation. In some cases, flywheel 303 may be provided to eliminate or reduce a pulsation created by the reciprocating motion of the plurality of pistons. Flywheel 303 may be any type of flywheel known in the art. Additionally, in some embodiments, flywheel 303 may be also associated with any type of transmission system of motor vehicle 101, which transmission systems are well known in the art.

In one embodiment, crankshaft 301 may also include damper 305. Damper 305 may be any type of damper known in the art. In some embodiments, damper 305 may include a harmonic balancer. In other embodiments, damper 305 may include a torsional damper. In some cases, damper 305 may add mass to the damper side of crankshaft 301 to balance a mass of flywheel 303 on the flywheel side. In other cases, damper 305 may be provided to reduce vibrations associated with the motion of engine 102. In an exemplary embodiment, damper 305 and flywheel 303 may be located on opposite ends of crankshaft 301.

In some embodiments, crankshaft 301 may include components configured to assist with the rotation of crankshaft 301 within engine 102. In some embodiments, crankshaft 301 may include main bearing journals 317. In an exemplary embodiment, main bearing journals 317 may be arranged along crankshaft axis 307. Main bearing journals 317 may be any type of bearing journal known in the art. In some embodiments, main bearing journals 317 may be associated with a plurality of bearings. In an exemplary embodiment, the plurality of bearings may be configured to hold crankshaft 301 in place within engine 102. With this arrangement, the plurality of bearings may allow crankshaft 301 to rotate about crankshaft axis 307.

In various embodiments, crankshaft 301 may have any number of main bearing journals 317. The plurality of main bearing journals 317 may also be placed at various locations on crankshaft 301. The number of main bearing journals 317 and the placement of main bearing journals 317 may be chosen based on criteria known in the art. In an exemplary embodiment, the number and placement of main bearing journals 317 on crankshaft 301 may be chosen to properly balance crankshaft 301. In this embodiment, crankshaft 301 includes three main bearing journals 317, one located at each end on the flywheel side and the damper side, as well as one located in the middle of crankshaft 301. In other embodiments, crankshaft 301 may include fewer or greater number of main bearing journals 317. Additionally, in other embodiments, the placement and arrangement of main bearing journals 317 on crankshaft 301 may vary.

In some embodiments, crankshaft 301 may include crankshaft journals 309. Crankshaft journals 309 may generally provide a surface on crankshaft 301 on which bearings located within engine 102 may ride. In some embodiments, crankshaft journals 309 may include a number of components. In an exemplary embodiment, each crankshaft journal 309 may include two crankshaft journal side walls connected at one end by a crankpin 313.

Crankpin 313 may be any type of crankshaft pin known in the art. Crankpin 313 may be made of any material known in the art. In some embodiments, crankpin 313 may be associated with the connecting rod of a piston. Crankpin 313 may serve as the connection point between the piston and crankshaft 301. With this arrangement, crankpin 313 may allow energy from the connecting rod to be transferred to crankshaft 301. In some embodiments, crankpin 313 may be spaced radially apart from crankshaft axis 307. The radial spacing may allow crankpin 313 to accommodate the reciprocal motion of the piston while allowing crankshaft 301 to rotate about crankshaft axis 307.

In some embodiments, crankpin 313 may lie between two crankshaft journal side walls. In some embodiments, each crankshaft journal side wall may have a damper side face and a flywheel side face. In one embodiment, crankpin 313 may be associated with a damper side face of one crankshaft journal side wall and associated with a flywheel side face of another crankshaft journal side wall.

In some embodiments, crankshaft journal side walls may include a first portion proximate crankpin 313 and a counterweight portion. In an exemplary embodiment, the counterweight portion of the crankshaft journal side wall may be spaced radially away from crankpin 313. With this arrangement, the counterweight portion of the crankshaft journal side wall may balance crankshaft journal 309 with respect to crankshaft axis 307.

In various embodiments, crankshaft journal side walls may be of any shape, configuration, and material known in the art. The shape, configuration, and material of crankshaft journal side walls may be chosen based on factors including, but not limited to: the desired number of crankshaft journals, an intended balance of crankshaft 301, an intended operational speed of crankshaft 301, and the type of engine.

In some embodiments, crankshaft journals 309 may include one or more types of crankshaft journal side walls. Referring again to FIG. 2, in this embodiment, crankshaft journal side walls may include a tapered side wall 315. Tapered side wall 315 may have a generally non-symmetrical ovoid shape with a greater amount of mass at one end than the other. Additionally, in some embodiments, crankshaft journal side walls may also include an elliptical side wall 311. Elliptical side wall 311 may have a generally symmetrical ovoid shape with approximately equal amounts of mass at either end. In other embodiments, crankshaft journals 309 may include one or more types of crankshaft journal side walls of similar or different shapes.

As shown in FIG. 3, in an exemplary embodiment, each crankshaft journal 309 may include tapered side wall 315 and elliptical side wall 311 connected at one end by crankpin 313. In an exemplary embodiment, two tapered side walls 315 may be associated with a shared elliptical side wall 311. Shared elliptical side wall 311 may be associated with one crankpin 313 on the flywheel side face and another crankpin 313 on the damper side face.

In some embodiments, a plurality of crankshaft journal side walls, including one or more of tapered side wall 315 and/or elliptical side wall 311, may be associated with multiple crankshaft components including other crankpins and bearing journals. In an exemplary embodiment, main bearing journal 317 may be associated with two crankshaft journal side walls located approximately in the middle of crankshaft 301. In this embodiment, main bearing journal 317 may be associated with the damper side face of one tapered side wall 315 and the flywheel side face of another tapered side wall 315.

In other embodiments, one or more crankshaft journal side walls may be associated with crankshaft components located at each end of crankshaft 301 on the flywheel side and the damper side, including one or more of main bearing journals 317, flywheel 303, and other crankshaft components. In one embodiment, a first crankshaft journal side wall 323 may be located adjacent to timing plate 321 at damper side of crankshaft 301. In this embodiment, first crankshaft journal side wall 323 may be a tapered side wall. In other cases, first crankshaft journal side wall 323 may have any shape. In an exemplary embodiment, first crankshaft journal side wall 323 may be configured to mate with timing plate 321, as further discussed below.

Figure 4:
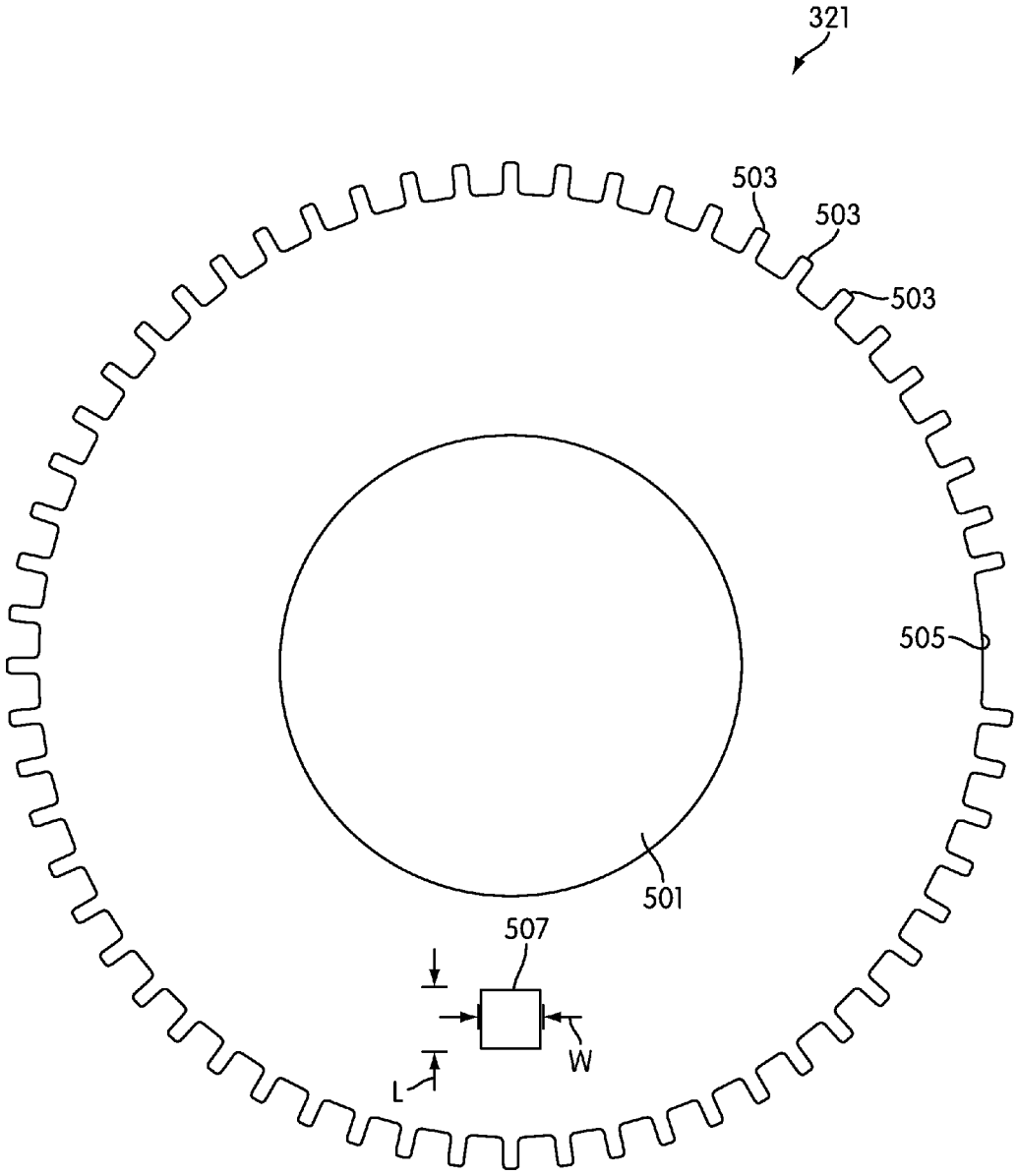
FIG. 4 is a front view of an exemplary embodiment of a timing plate.
Figure 5:
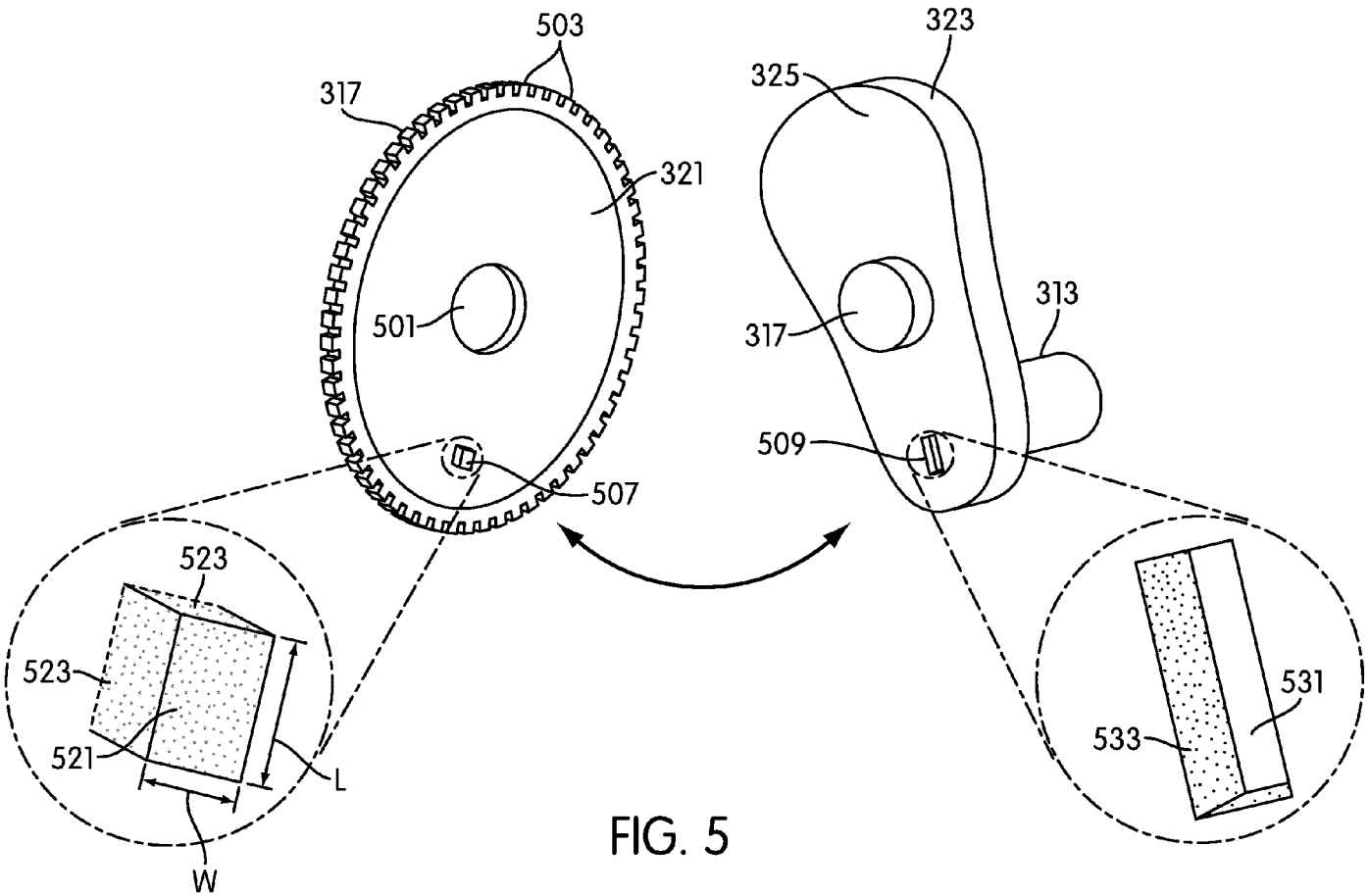
FIG. 5 is an exploded view of an exemplary embodiment of a timing plate and a crankshaft journal side wall.

FIGS. 4 and 5 illustrate an exemplary embodiment of a timing plate that may be associated with a crankshaft. In some embodiments, timing plate 321 may be configured to reduce the total mass of crankshaft 301. In an exemplary embodiment, timing plate 321 may reduce the total mass of crankshaft 301 by eliminating a connecting element, such as a bolt, between timing plate 321 and crankshaft 301. In some embodiments, timing plate 321 may be configured to synchronize the movement of crankshaft 301 with other components and/or systems associated with engine 102, including, but not limited to timing control of an ignition system and/or a fuel injection system, as is well known in the art. In some embodiments, timing plate 321 may be used in engines which do not employ other typical mechanisms to coordinate crankshaft motion and timing control, such as timing belts or chains.

FIG. 4 shows a frontal view of an embodiment of timing plate 321. In this embodiment, timing plate 321 may have a central hole 501, a plurality of timing elements 503, and at least one protruding portion 507. In an exemplary embodiment, an axial portion of crankshaft 301 may extend through central hole 501 in timing plate 321. The term "axial portion" refers to a crankshaft element lying on crankshaft axis 307. In some embodiments, the axial portion may be symmetric about crankshaft axis 307. In an exemplary embodiment, the axial portion may have a substantially circular cross-section with respect to crankshaft axis 307. In one embodiment, main bearing journal 317 may extend through central hole 501, as shown in FIGS. 2 and 3, described above.

In some embodiments, central hole 501 may be configured to allow the axial portion of crankshaft 301 to pass through timing plate 321. In some cases, central hole 501 may be substantially circular. In an exemplary embodiment, central hole 501 may have a slightly larger diameter than a diameter of the axial portion. With this arrangement, timing plate 321 may be configured to rotate around the axial portion of crankshaft 301. In one embodiment, timing plate 321 may be configured to move freely or float around the axial portion of crankshaft 301 extending through central hole 501.

In some embodiments, timing plate 321 may be configured to rotate with crankshaft 301. In some cases, timing plate 321 may rotate at substantially the same speed as crankshaft 301. Each full rotation of crankshaft 301 includes the crankshaft rotating through 360 degrees. At any given time, crankshaft 301 may be at a particular angle between 1 to 360 degrees in the rotation. This angular position of crankshaft 301 at a given time may be referred to as the "rotational angle" or "crank angle."

In some embodiments, motor vehicle 101 may monitor the crank angle using a crank angle sensor (not shown). In some embodiments, engine 102 may include additional components configured to be used in conjunction with a crank angle sensor, including, but not limited to a timing plate. In an exemplary embodiment, timing plate 321 may be associated with a crank angle sensor that may be configured to read or sense indicia on timing plate 321. In some cases, the crank angle sensor may be an optical sensor. In other cases, the crank angle sensor may be a magnetic sensor. In various embodiments, timing plate 321 may be associated with any type of crank angle sensor known in the art.

In some embodiments, the crank angle sensor may detect the rotational angle of crankshaft 301. The crank angle sensor may be connected to electronic control unit associated with engine 102 for supplying signals corresponding to the rotational angle of crankshaft 301. In some embodiments, the crank angle sensor may generate a pulse at various predetermined rotational angles of crankshaft 301 corresponding to various rotational angles of crankshaft 301 and/or pistons within engine 102. In various embodiments, the signals supplied from the crank angle sensor may be used by one or more systems associated with engine 102, including, but not limited to an ignition system and/or a fuel injection system, for timing control operations associated with fuel injection timing, ignition timing, and other controls, as well as determining the rotational speed of engine 102.

In some embodiments, the crank angle sensor may monitor one or more timing elements 503 on timing plate 321 to determine the crank angle. In various embodiments, the crank angle sensor may monitor timing elements 503 using any method known in the art. In some cases, timing elements 503 may rotate with timing plate 321. With this arrangement, timing elements 503 may rotate at substantially the same speed as crankshaft 301. By monitoring the plurality of timing elements 503, the crank angle sensor may determine the crank angle of crankshaft 301 during rotation.

In various embodiments, timing elements 503 may be any type of indicia or structure capable of creating a detectable contrast on the surface of timing plate 321. In some embodiments, timing elements 503 may include markings spaced at known angular positions about timing plate 321. In other embodiments, timing elements 503 may include gear teeth spaced around a circumference of timing plate 321. In still other embodiments, timing elements 503 may include hash marks formed on a periphery surface of timing plate 321. In various embodiments, timing elements 503 may include combinations of any or all of these different types of timing elements.

In some embodiments, timing plate 321 may include an element gap 505. Element gap 505 may be a region lacking timing elements 503. In some embodiments, element gap 505 may be positioned to correspond to a crank angle of zero. In other embodiments, element gap 505 may correspond to a top dead center position of one or more pistons within engine 102 when timing plate 321 is positioned in an initial position. In other embodiments, element gap 505 may correspond to any desired crank angle position of crankshaft 301 and/or position of one or more pistons within engine 102. In other embodiments, timing plate 321 may include more than one element gap corresponding to different crank angle positions.

In some embodiments, element gap 505 may be used to calibrate timing plate 321 and/or provide an indicator of a full rotation of timing plate 321. In an exemplary embodiment, element gap 505 may be used by the crank angle sensor to provide a top dead center signal or other signal associated with a predetermined rotational angle of crankshaft 301 to one or more systems associated with engine 102, including, but not limited to an ignition system and/or a fuel injection system, for timing control operations associated with fuel injection timing, ignition timing, and other controls, as well as determining the rotational speed of engine 102.

In some embodiments, timing plate 321 may include one or more components that may be configured to mate, or otherwise removably associate, timing plate 321 with crankshaft 301. In an exemplary embodiment, timing plate 321 may include a protruding portion 507. In various embodiments, protruding portion 507 may be any shape. In some cases, protruding portion 507 may be a geometric shape, including, but not limited to prisms, cones, pyramids, cylinders, as well as other geometric shapes. In other cases, protruding portion 507 may be an irregular shape. In an exemplary embodiment, protruding portion 507 may be a substantially rectangular prism, as further described below.

Figure 6:
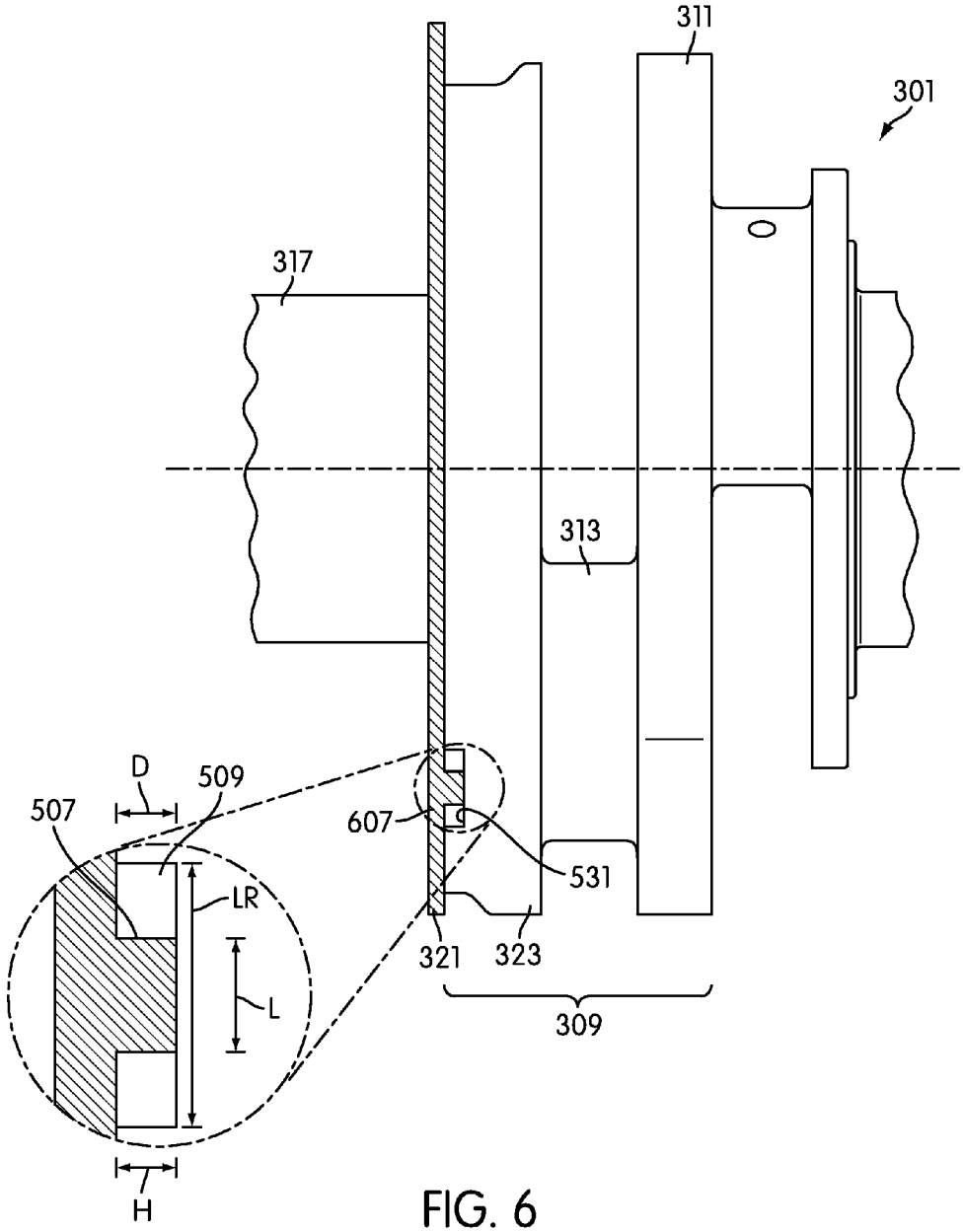
FIG. 6 is a side view of a portion of a crankshaft showing a crankshaft journal and an exemplary embodiment of a timing plate mated together.
Figure 7:
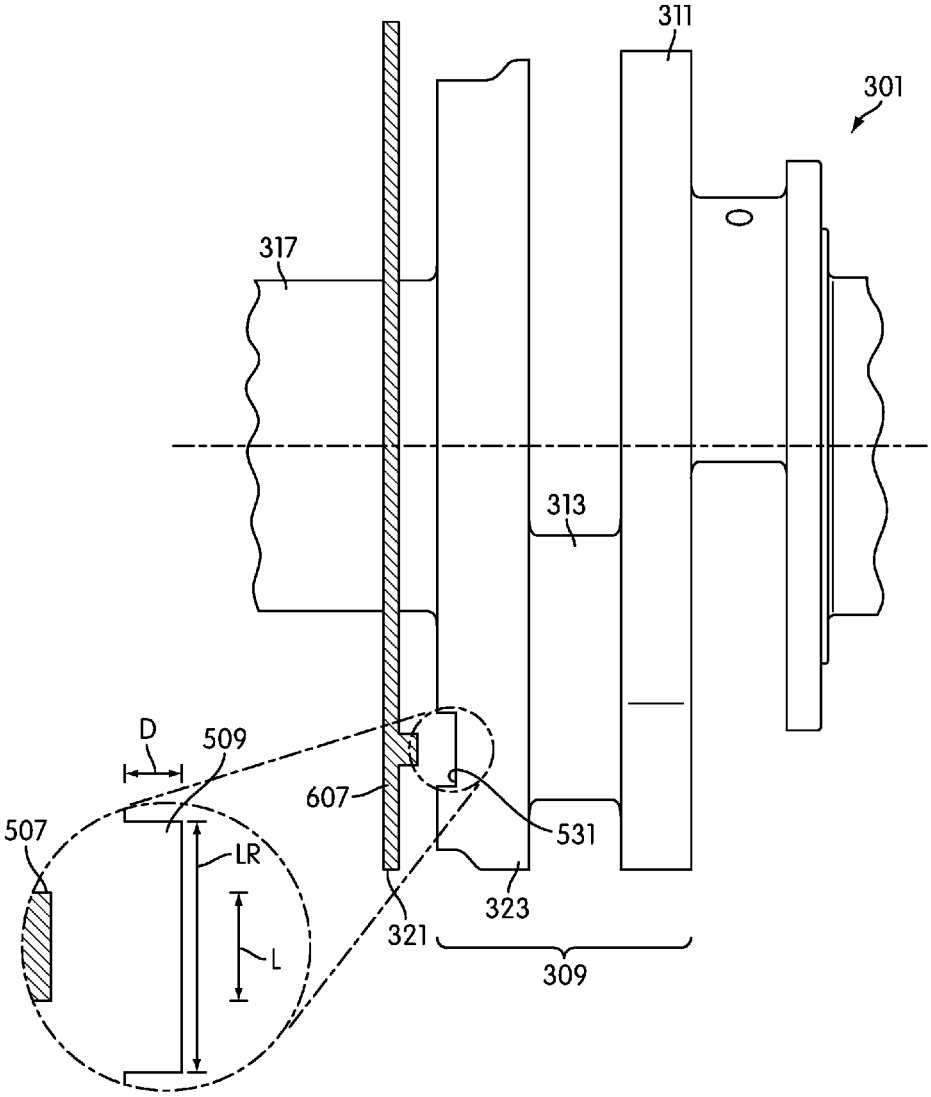
FIG. 7 is a side view of a portion of a crankshaft showing a crankshaft journal and an exemplary embodiment of a timing plate.

FIGS. 5 through 7 further illustrate protruding portion 507 of timing plate 321 associated with one or more portions of crankshaft 301. Referring now to FIG. 5, an exploded view of crankshaft 301 is illustrated. FIG. 5 illustrates a damper side of first crankshaft journal side wall 323 and a flywheel side of timing plate 321.

As shown in FIG. 5, in this embodiment, protruding portion 507 is a substantially rectangular prism. Protruding portion 507 may generally be defined by a protruding length L and a protruding width W. In this embodiment, protruding length L may be measured in the radial direction of timing plate 321. Similarly, protruding width W may be measured in a direction perpendicular to protruding length L. Additionally, protruding portion 507 may extend in the axial direction. In this embodiment, protruding portion 507 may generally be defined by a height H in the axial direction. In this embodiment, height H may extend from a surface of timing plate 321 to a tip 521 of protruding portion 507.

In various embodiments, timing plate 321 may have any number of protruding portions 507. In an exemplary embodiment, timing plate 321 may include one protruding portion 507. In other embodiments, timing plate 321 may include two protruding portions 507. In still other embodiments, timing plate 321 may include four protruding portions 507. As shown in FIGS. 4-7, timing plate 321 has one protruding portion 507.

In various embodiments, one or more protruding portions 507 may be disposed on timing plate 321 in numerous patterns or arrangements. In some embodiments, multiple protruding portions 507 may be disposed symmetrically or asymmetrically on timing plate 321. In some embodiments, one or more protruding portions 507 may be disposed at varying radial distances between center hole 501 and an outermost periphery of timing plate 321.

In some embodiments, one or more portions of crankshaft 301 may be configured to mate or associate with a portion of timing plate 321. In an exemplary embodiment, one or more portions of a component associated with crankshaft 301 may be configured to mate or associate with protruding portion 507. In one embodiment, crankshaft 301 may include a receiving portion 509 that may be configured to receive protruding portion 507 of timing plate 321. In an exemplary embodiment, receiving portion 509 may be a cavity in a surface of crankshaft 301. In one embodiment, receiving portion 509 may be a cavity in an axial facing surface 325 of crankshaft 301. In an exemplary embodiment, axial facing surface 325 may be adjacent to timing plate 321. In one embodiment, axial facing surface 325 may face tip 521 of protruding portion 507 of timing plate 321. As shown in FIGS. 5-7, receiving portion 509 is a cavity in axial facing surface 325 of first crankshaft journal side wall 323.

In various embodiments, receiving portion 509 may define a cavity of any shape. In some cases, receiving portion 509 may be a geometric shape, including, but not limited to prisms, cones, pyramids, cylinders, as well as other geometric shapes. In other cases, receiving portion 509 may be an irregular shape. In an exemplary embodiment, receiving portion 509 may be a substantially rectangular prism shaped cavity. In one embodiment, receiving portion 509 may be configured to substantially correspond to a shape of protruding portion 507. In this embodiment, receiving portion 509 and protruding portion 507 are both substantially rectangular prism shaped. In other embodiments, receiving portion 509 and protruding portion 507 may be other similar shapes, including, but not limited to substantially cylindrical shaped. In other embodiments, receiving portion 509 and protruding portion 507 may be different shapes. For example, in one embodiment, protruding portion 507 may be substantially cylindrical shaped, while receiving portion 509 may be substantially rectangular prism shaped.

In some embodiments, receiving portion 509 may extend into crankshaft 301 in the axial direction. In an exemplary embodiment, receiving portion 509 may be defined by a depth D in the axial direction within first crankshaft journal side wall 323. In this embodiment, depth D may extend from axial facing surface 325 to a receiving portion bottom 531.

In various embodiments, depth D of receiving portion 509 may be larger, smaller or equal to height H of protruding portion 507. In an exemplary embodiment, depth D of receiving portion 509 may be substantially equal to height H of protruding portion 507. Referring now to FIG. 6, in this embodiment, depth D of receiving portion 509 is substantially equal to height H of protruding portion 507. With this arrangement, timing plate 321 may sit approximately flush against axial facing surface 325 when depth D of receiving portion 509 equals or is larger than height H of protruding portion 507.

In some embodiments, receiving portion 509 may also be defined by width and length dimensions. In an exemplary embodiment, receiving portion 509 may be defined by a receiving length LR and a receiving width WR. Receiving length LR may be measured in the radial direction. Receiving width WR may be measured in a direction perpendicular to receiving length LR.

In some embodiments, the dimensions of receiving portion 509 may be configured to allow protruding portion 507 to mate with receiving portion 509. In some embodiments, protruding length L may be smaller or substantially equal to receiving length LR. In some embodiments, protruding width W may be smaller or substantially equal to receiving width WR. As shown in FIGS. 5-7, receiving length LR is larger than protruding length L and receiving width WR is substantially equal to protruding width W. In various embodiments, receiving length LR and receiving width WR, along with depth D, described above, may be any desired size. In some embodiments, receiving length LR and receiving width WR of receiving portion 509 may be chosen so as to substantially correspond to the dimensions of protruding portion 507. In other embodiments, receiving length LR and receiving width WR may be larger than the dimensions of protruding portion 507. In some embodiments, the dimensions of receiving portion 509 may be larger than the dimensions of protruding portion 507 to allow for adjustment of the position of timing plate 321 relative to crankshaft 301.

In various embodiments, crankshaft 301 may include any number of receiving portions 509. In some embodiments, crankshaft 301 may include an equal number of receiving portions 509 and protruding portions 507. In other embodiments, crankshaft 301 may include multiple receiving portions 509 disposed at various locations on crankshaft 301. In some cases, one or more receiving portions 509 may correspond to particular rotational angles of crankshaft 301 and/or pistons within engine 102. In some embodiments, different receiving portions 509 located on crankshaft 301 may allow for adjustment of the position of timing plate 321 relative to crankshaft 301. As shown in FIGS. 4-7, crankshaft 301 includes one protruding portion 507 and one receiving portion 509.

FIGS. 5 and 6 illustrate an exemplary embodiment of protruding portion 507 mating with receiving portion 509 to thereby attach, or temporarily associate, timing plate 321 with crankshaft 301. In some embodiments, protruding portion 507 may mate, or otherwise temporarily associate, with receiving portion 509 during operation of crankshaft 301. In an exemplary embodiment, the mating of protruding portion 507 and receiving portion 509 may connect timing plate 321 to crankshaft 301. With this arrangement, timing plate 321 may be configured to rotate with crankshaft 301. When crankshaft 301 rotates during crankshaft operation, first crankshaft journal side wall 323 will rotate along with crankshaft 301. In this embodiment, receiving portion 509 will rotate with first crankshaft journal side wall 323. With this arrangement, receiving portion 509 will rotate with rotation of crankshaft 301.

In some embodiments, as receiving portion 509 associated with a portion of crankshaft 301 rotates, the rotation may cause a receiving portion side wall 533 of receiving portion 509 to contact a protruding portion side wall 523 of protruding portion 507 that has been mated with receiving portion 509. With this arrangement, rotational force may be transferred from receiving portion side wall 533 to protruding portion side wall 523. The rotational force may then be transferred to the remainder of timing plate 321. With this arrangement, timing plate 321 may rotate with crankshaft 301. In an exemplary embodiment, timing plate 321 may rotate at substantially the same speed as crankshaft 301.

FIGS. 6 and 7 illustrate cross-sections of crankshaft 301 in the region around first crankshaft journal side wall 323 and timing plate 321. FIGS. 6 and 7 further illustrate the nature of the connection between timing plate 321 and crankshaft 301 formed by the mating of protruding portion 507 and receiving portion 509. In some embodiments, mating protruding portion 507 to receiving portion 509 may allow timing plate 321 to rotate along with crankshaft 301, while allowing timing plate 321 freedom of movement along the axial direction.

As shown in FIG. 7, in an exemplary embodiment, the temporary association between timing plate 321 and crankshaft 301 caused by mating of protruding portion 507 to receiving portion 509 may allow timing plate 321 to move away from crankshaft 301. In some embodiments, the removable association between timing plate 321 and crankshaft 301 may allow timing plate 321 to move freely or "float" on an axial portion of crankshaft 301 extending through central hole 501. In one embodiment, timing plate 321 may slide along main bearing journal 317, in the axial direction, away from first crankshaft journal side wall 323. With this arrangement, timing plate 321 may be allowed to detach from a mating or temporary association with crankshaft 301.

In contrast, conventional timing plates may be bolted to the crankshaft. Bolting the conventional timing plate to the crankshaft allows the conventional timing plate to rotate with the crankshaft. This arrangement, however, increases the total mass of the crankshaft due to the added mass of the bolts. Additionally, the mass of the bolts must also be balanced, both statically and dynamically on the crankshaft. The present embodiments of timing plate 321, described herein, are configured to rotate along with crankshaft 301 without using such bolts or other similar connecting elements.

Figure 8:
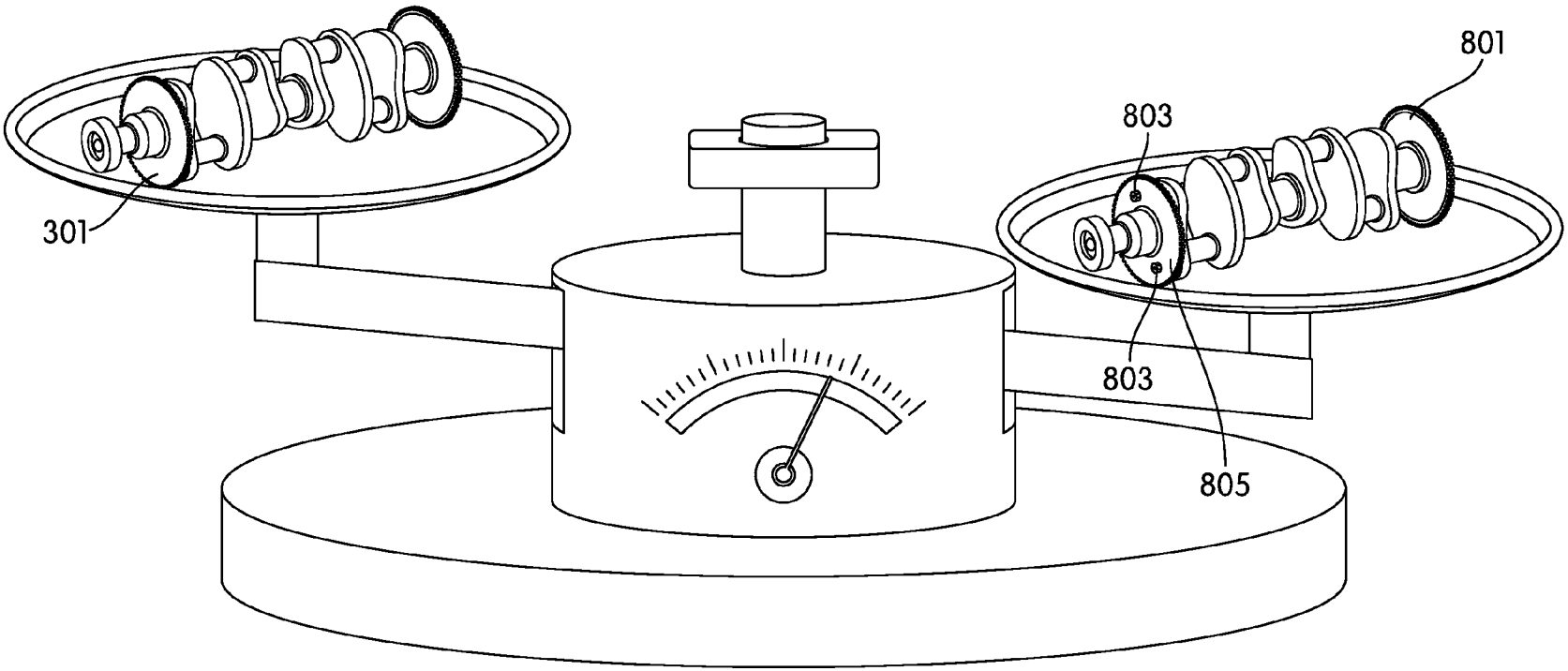
FIG. 8 is a representative view of the relative difference in mass between a conventional crankshaft with a connected timing plate and an exemplary embodiment of a crankshaft.

Referring now to FIG. 8, a representative view of the relative difference in mass between a conventional crankshaft with a connected timing plate and an exemplary embodiment of a crankshaft is shown. In an exemplary embodiment, by mating or otherwise temporarily associating timing plate 321 to crankshaft 301 using protruding portion 507 and receiving portion 509, as described above, the total mass of crankshaft 301 may be smaller than a conventional crankshaft.

FIG. 8 shows a balance scale having a first balance plate containing an exemplary embodiment of timing plate 321 associated with crankshaft 301 by the mating of protruding portion 507 and receiving portion 509. On a second balance plate, a conventional timing plate 805 is connected to a conventional crankshaft 801 by two bolts 803. In this embodiment, conventional crankshaft 801 may be substantially the same as crankshaft 301, other than the addition of two bolts 803 that connect conventional timing plate 805 to conventional crankshaft 801. FIG. 8 shows that the additional mass of bolts 803 may cause the combination of conventional crankshaft 801 and conventional timing plate 805 to have a greater mass than crankshaft 301 associated with timing plate 321. It should be understood that the amount of mass reduced by the present embodiment of crankshaft 301 associated with timing plate 321 shown in FIG. 8 is merely exemplary. In various embodiments, the amount of mass reduced may depend on a number of different factors, including the number of bolts connected to the conventional crankshaft, as well as materials used for making individual components of the crankshafts.

Figure 9:
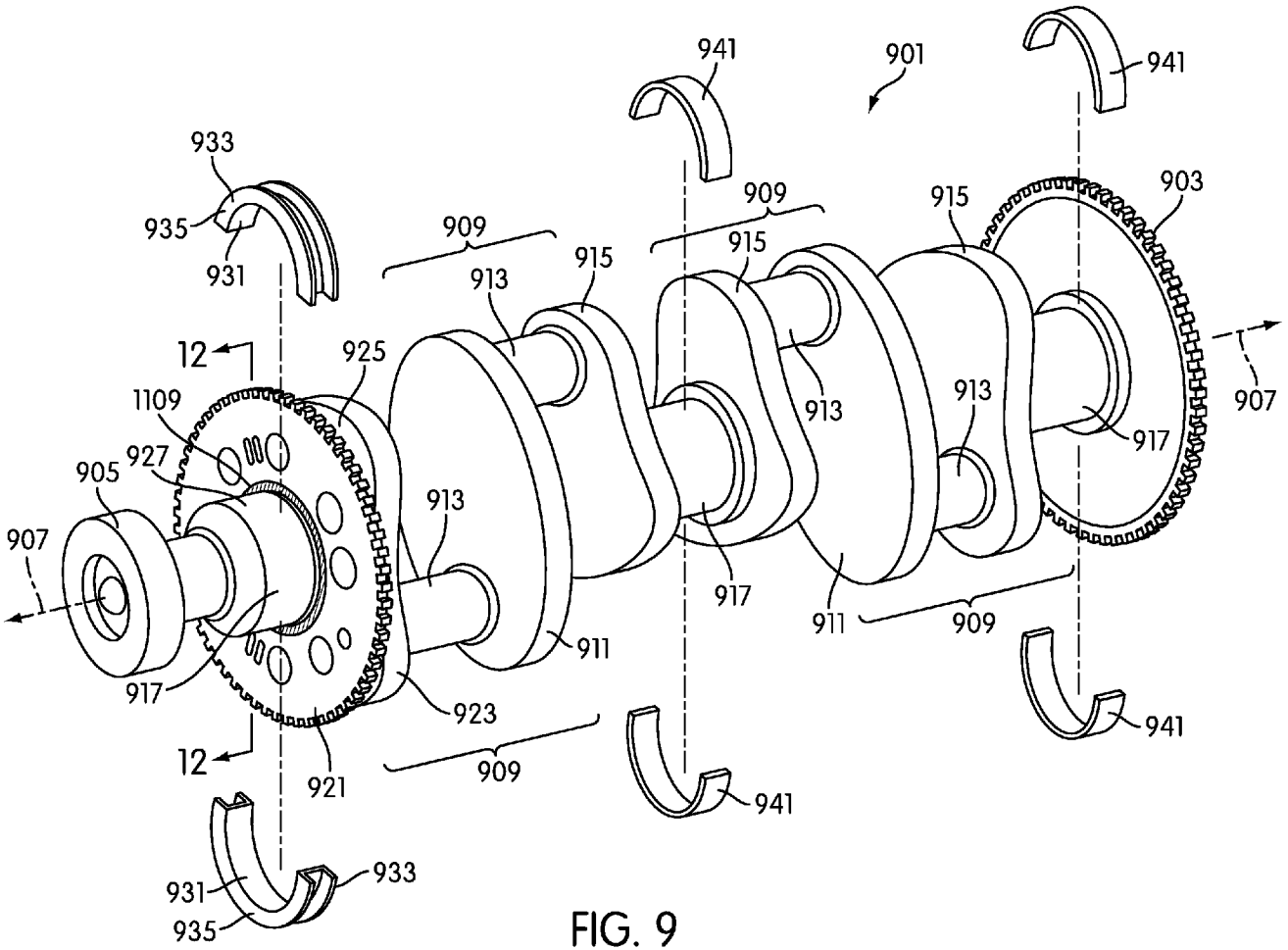
FIG. 9 is an isometric view of an alternate embodiment of a crankshaft.

FIG. 9 illustrates an alternate embodiment of a crankshaft 901. In some embodiments, crankshaft 901 may be associated with one or more components, including one or more components substantially similar to components associated with crankshaft 301, discussed above. In one embodiment, crankshaft 901 may include a flywheel 903, a damper 905, a plurality of crankshaft journals 909, a plurality of main bearing journals 917, and a timing plate 921. In some embodiments, crankshaft 901 may define a crankshaft axis 907 along the length of crankshaft 901. In some embodiments, crankshaft 901 may be supported by one or more bearings 941 and a flanged bearing 931.

In some embodiments, crankshaft 901 may include components configured to reduce vibrations or other characteristics associated with the reciprocating motion of the plurality of pistons. In one embodiment, crankshaft 901 may include flywheel 903. In some embodiments, flywheel 903 may store rotational energy to provide a smother engine rotation. In some cases, flywheel 903 may be provided to eliminate or reduce a pulsation created by the reciprocating motion of the plurality of pistons. Flywheel 903 may be any type of flywheel known in the art. Additionally, in some embodiments, flywheel 903 may be also associated with any type of transmission system of a motor vehicle, which transmission systems are well known in the art.

In one embodiment, crankshaft 901 may also include damper 905. Damper 905 may be any type of damper known in the art. In some embodiments, damper 905 may include a harmonic balancer. In other embodiments, damper 905 may include a torsional damper. In some cases, damper 905 may add mass to the damper side of crankshaft 901 to balance a mass of flywheel 903 on the flywheel side. In other cases, damper 905 may be provided to reduce vibrations associated with the motion of an engine. In an exemplary embodiment, damper 905 and flywheel 903 may be located on opposite ends of crankshaft 901.

In some embodiments, crankshaft 901 may include components configured to assist with the rotation of crankshaft 901 within an engine. In some embodiments, crankshaft 901 may include main bearing journals 917. In an exemplary embodiment, main bearing journals 917 may be arranged along crankshaft axis 907. Main bearing journals 917 may be any type of bearing journal known in the art. In some embodiments, main bearing journals 917 may be associated with a plurality of bearings. In an exemplary embodiment, main bearing journals 917 may be associated with one or more bearings 941 and flanged bearing 931. In one embodiment, bearings 941 and flanged bearing 931 may hold crankshaft 901 in place within an engine. In this embodiment, bearings 941 and flanged bearing 931 may allow crankshaft 901 to rotate about crankshaft axis 907.

In various embodiments, bearings 941 and flanged bearing 931 may be any type of bearing known in the art. In one embodiment, bearings 941 and/or flanged bearing 931 may be a plain bearing. In another embodiment, one or more of bearings 941 and/or flanged bearing 931 may be a thrust bearing. In additional embodiments, bearings 941 and/or flanged bearing 931 may be a combination of one or more types of bearings. In an exemplary embodiment, flanged bearing 931 may include a flange 933. In some cases, flanged bearing 931 may include flange 933 disposed on one or more of damper side and flywheel side of flanged bearing 931. In other cases, flanged bearing 931 may include flange 933 on only one side. In an exemplary embodiment, flange 933 may further include a bearing thrust surface 935. In some cases, bearing thrust surface 935 may be disposed on one or more of damper side and flywheel side of flange 933. In other cases, flange 933 may include bearing thrust surface 935 on only one side.

In some embodiments, crankshaft 901 may include crankshaft journals 909. Crankshaft journals 909 may generally provide a surface on crankshaft 901 on which bearings located within an engine may ride. In some embodiments, crankshaft journals 909 may include a number of components including one or more components substantially similar to components associated with crankshaft journals 309, discussed above. In an exemplary embodiment, each crankshaft journal 909 may include two crankshaft journal side walls connected at one end by a crankpin 913. Crankpin 913 may be any type of crankshaft pin known in the art. In an exemplary embodiment, crankpin 913 may be substantially similar to crankpin 313, discussed above.

In some embodiments, crankpin 913 may lie between two crankshaft journal side walls. In some embodiments, each crankshaft journal side wall may have a damper side face and a flywheel side face. In one embodiment, crankpin 913 may be associated with a damper side face of one crankshaft journal side wall and associated with a flywheel side face of another crankshaft journal side wall.

In an exemplary embodiment, crankshaft journals 909 may include one or more crankshaft journal side walls, including a tapered side wall 915 and an elliptical side wall 911. Tapered side wall 915 and elliptical side wall 911 may be substantially similar to, respectively, tapered side wall 315 and elliptical side wall 311, discussed above. In other embodiments, crankshaft journals 909 may include one or more types of crankshaft journal side walls of similar or different shapes. The function and operation of crankshaft journals 909 is substantially similar to crankshaft journals 309 described above, and will not be further discussed here.

Additionally, as shown in FIG. 9, in one embodiment, timing plate 921, as described in more detail below, may be located proximate a first crankshaft journal side wall 923. In some embodiments, first crankshaft journal side wall 923 may be substantially similar to first crankshaft journal side wall 323, discussed above.

Figure 10:
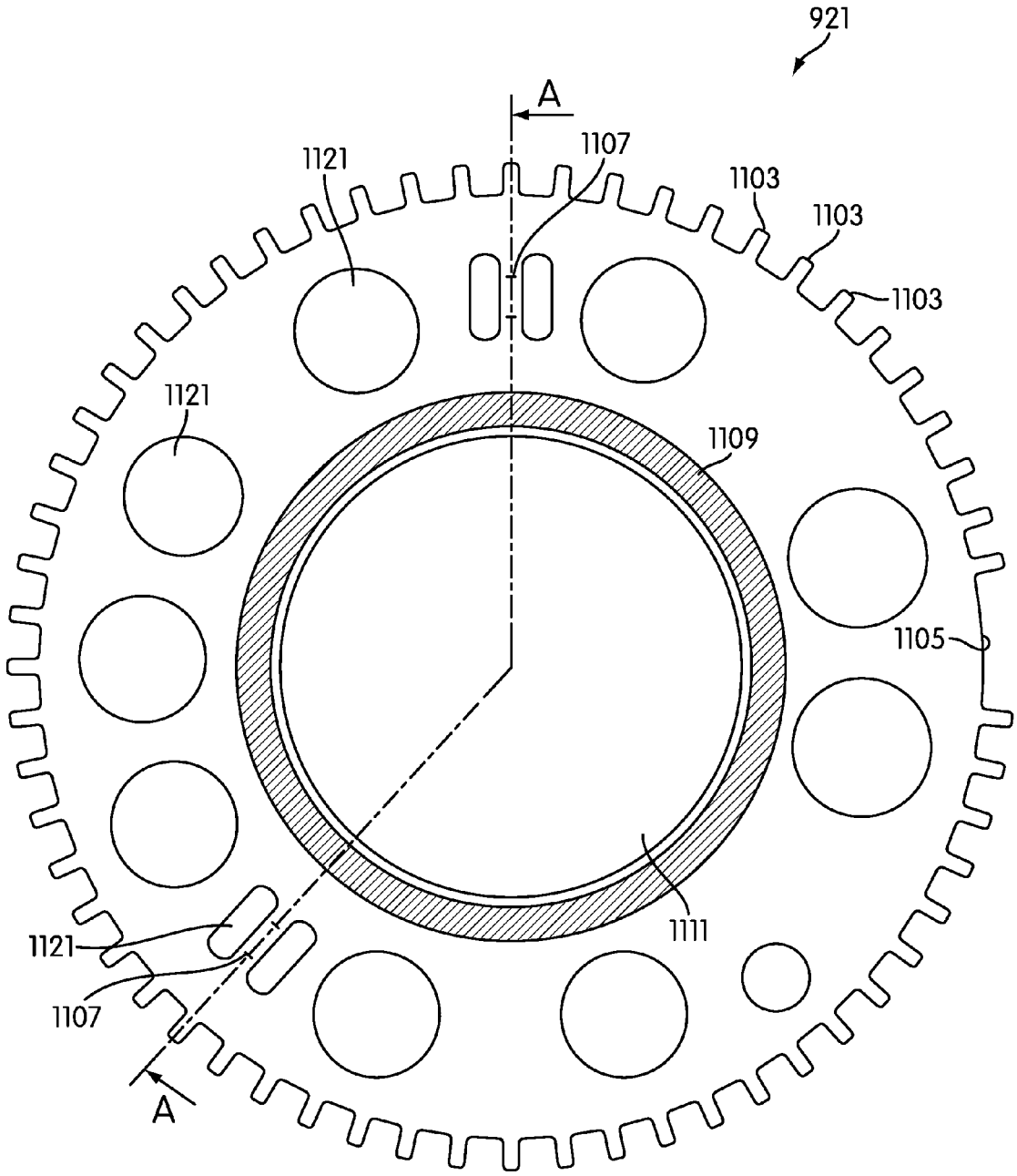
FIG. 10 is a front view of an alternate embodiment of a timing plate including a thrust surface.

Referring now to FIG. 10, a frontal view of an alternate embodiment of timing plate 921 is shown. In this embodiment, timing plate 921 may have a central hole 1111, a plurality of indicia 1103, at least one protruding portion 1107, and a thrust surface 1109. In some embodiments, timing plate 921 may also include a plurality of holes 1121 designed to reduce the mass and/or balance of timing plate 921. In various embodiments, plurality of holes 1121 may include one or more types or shapes of holes and may be arranged on timing plate 921 in any symmetrical or asymmetrical configuration as desired to affect the mass and/or balance of timing plate 921.

In various embodiments, indicia 1103 may be any type of indicia known in the art. In some embodiments, indicia 1103 may be substantially similar to timing elements 503, discussed above. In some embodiments, indicia 1103 may include gear teeth spaced around a circumference of timing plate 921. In other embodiments, indicia 1103 may include markings spaced at known angular positions about timing plate 921. In still other embodiments, indicia 1103 may include hash marks formed on a periphery surface of timing plate 921. In various embodiments, indicia 1103 may include combinations of any or all of these different types of indicia. The function and operation of indicia 1103 on timing plate 921 may be substantially similar as explained above in regard to timing elements 503. Additionally, indicia 1103 may be used by one or more systems associated with a motor vehicle, for example, using a crank angle sensor, to determine a crank angle or rotational angle of a crankshaft, as discussed in detail above.

In some embodiments, timing plate 921 may also include an element gap 1105. Element gap 1105 may be a region on the periphery of timing plate 921 that lacks indicia 1103. In an exemplary embodiment, element gap 1105 may be substantially similar to element gap 505, discussed above. In other embodiments, timing plate 921 may include multiple element gaps. In still other embodiments, timing plate 921 may not include any element gaps.

In an exemplary embodiment, an axial portion of crankshaft 901 may extend through central hole 1111 in timing plate 921. In some embodiments, the axial portion may be symmetric about crankshaft axis 907. In an exemplary embodiment, the axial portion may have a substantially circular cross-section with respect to crankshaft axis 907. As shown in FIG. 9, in one embodiment, a first main bearing journal 927, associated with flanged bearing 931, may extend through central hole 1111.

In some embodiments, central hole 1111 may be configured to allow the axial portion of crankshaft 901 to pass through timing plate 921. In some cases, central hole 1111 may be substantially circular. In an exemplary embodiment, central hole 1111 may have a slightly larger diameter than a diameter of the axial portion. With this arrangement, timing plate 921 may be configured to rotate around the axial portion of crankshaft 901. In one embodiment, timing plate 921 may be configured to move freely or float around the first main bearing journal 927 of crankshaft 901 extending through central hole 1111.

Figure 11:
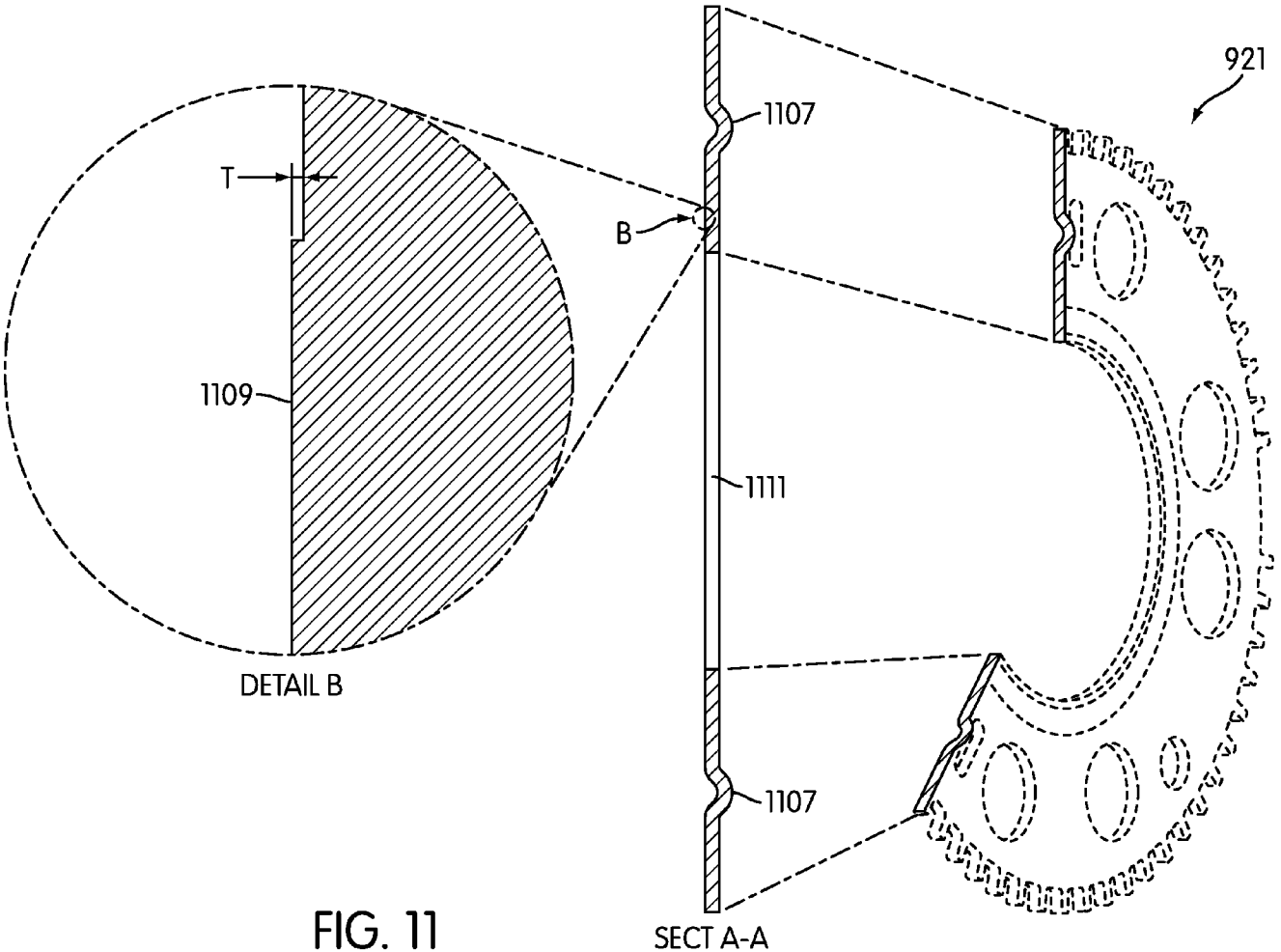
FIG. 11 is a cross-section of an alternate embodiment of a timing plate including a thrust surface taken along line A-A of FIG. 10.

In some embodiments, timing plate 921 may include one or more components that may be configured to mate, or otherwise removably associate, timing plate 921 with crankshaft 901. In an exemplary embodiment, timing plate 921 may include one or more protruding portions 1107 for mating with a receiving portion associated with crankshaft 901. As shown in FIG. 11, described below, in this embodiment, timing plate 921 may include two protruding portions 1107. The nature of the mating between the protruding portion and the receiving portion may be substantially the same as discussed above with regard to the embodiment shown in FIGS. 4-7. In one embodiment, protruding portions 1107 may be substantially semi-circular shapes. In other embodiments, protruding portions 1107 may be any shape, including, but not limited to prisms, cones, pyramids, cylinders, as well as other geometric shapes or irregular shapes.

In an exemplary embodiment, one or more portions of a component associated with crankshaft 901 may be configured to mate or associate with protruding portions 1107. In one embodiment, crankshaft 901 may include one or more receiving portions that may be configured to receive protruding portions 1107 of timing plate 921. In an exemplary embodiment, the receiving portions may be cavities in a surface of crankshaft 901. In one embodiment, the receiving portions may be substantially similar to receiving portion 509, discussed above.

In various embodiments, the receiving portions may define cavities of any shape. In an exemplary embodiment, the receiving portions may be a substantially rectangular prism shaped cavity. In this embodiment, receiving portions may be sized and dimensioned so as to substantially accept receiving portions 1107 within the cavities. In one embodiment, receiving portions and protruding portions 1107 may be different shapes. In one embodiment, protruding portions 1107 may be substantially semi circular shaped, while the receiving portions may be substantially rectangular prism shaped. In other embodiments, the receiving portions may be configured to substantially correspond to a shape of protruding portions 1107. In other embodiments, the receiving portions and protruding portions 1107 may be other shapes, as discussed above.

Referring now to FIG. 11, a cross-section of timing plate 921 taken along line A-A from FIG. 10 is illustrated. In this embodiment, protruding portions 1107 may include semicircular cross-sectional shapes. As discussed above, in other embodiments, the shapes of protruding portions 1107 may vary.

FIG. 11 also illustrates a cross-sectional view of thrust surface 1109. The term "thrust surface," as used in this description and claims, refers to two opposing surfaces placed in close proximity to each other (in the crankshaft axis direction) with a layer of fluid, typically motor oil, between the two thrust surfaces to dampen axial motion. In some embodiments, thrust surface 1109 may be any type of thrust surface known in the art. In an exemplary embodiment, thrust surface 1109 may be a raised portion of the surface of one side of timing plate 921. As shown in FIG. 11, in this embodiment, thrust surface 1109 is raised a distance T in the axial direction from the remainder of a surface of timing plate 921. In one embodiment, thrust surface 1109 may be disposed proximate one or more portions of flanged bearing 931.

In various embodiments, flanged bearing 931 may be any type of bearing known in the art, as discussed above. In this embodiment, flanged bearing 931 may serve two functions. In one case, flanged bearing 931 may support crankshaft 901 within the engine, while allowing crankshaft 901 to rotate, in the same manner as bearings 941. In another case, flanged bearing 931 may also absorb axial crankshaft movement. In an exemplary embodiment, flanged bearing 931 may include one or more flanges 933 having bearing thrust surfaces 935, as described above.

Figure 12:
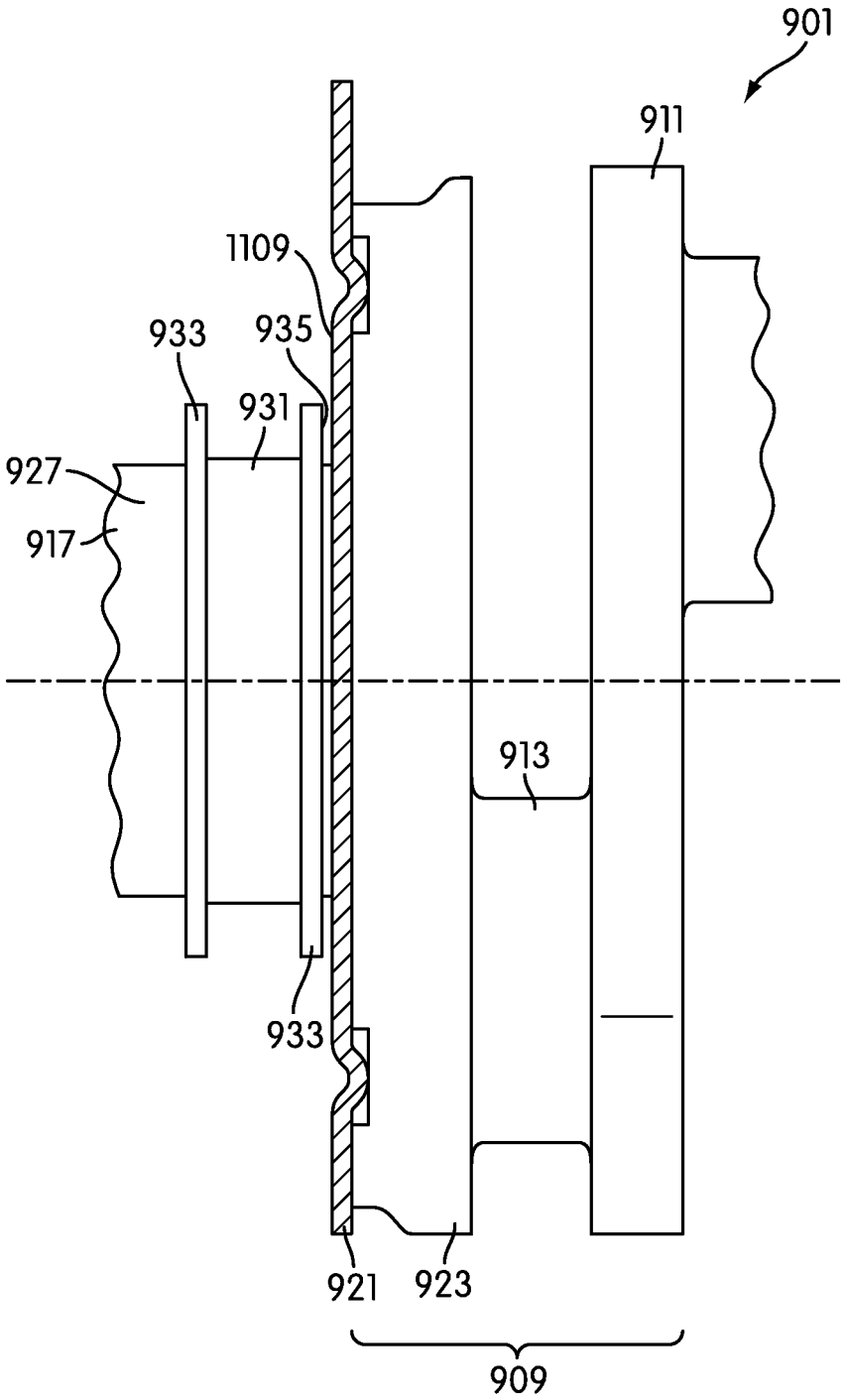
FIG. 12 is a side view of a portion of a crankshaft showing a crankshaft journal and an alternate embodiment of a timing plate including a thrust surface mated together.

Referring now to FIG. 12, a side view of a portion of crankshaft 901 is illustrated showing the spatial relationship between bearing thrust surface 935 and thrust surface 1109 of timing plate 921. In this embodiment, timing plate 921 may be disposed on first main bearing journal 927 between crankshaft journal 909 and flanged bearing 931. In an exemplary embodiment, thrust surface 1109 may extend axially towards flanged bearing 931. In one embodiment, thrust surface 1109 may be radially disposed on timing plate 921 so as to substantially align with flange 933 of flanged bearing 931. With this arrangement, bearing thrust surface 935 associated with flange 933, may be disposed opposite thrust surface 1109 of timing plate 921.

In some embodiments, during operation of the engine, oil may be placed in the space or gap between flange 933 and timing plate 921. The oil may fill the space or gap between bearing thrust surface 935 and thrust surface 1109. With this arrangement, the axial motion of crankshaft 901 may be dampened or absorbed by the oil, as is known in the art.

In some embodiments, associating thrust surface 1109 with a portion of timing plate 921 may reduce the number of components necessary in crankshaft 901. Specifically, in one embodiment, disposing thrust surface 1109 on timing plate 921 may combine two functions into a single component. With this arrangement, reducing the number of components may reduce mass and complexity in the engine.

While various embodiments have been described, the description is intended to be exemplary, rather than limiting. It will be apparent to those of ordinary skill in the art, that many more embodiments and implementations are possible that are within the scope of the claims. Accordingly, the embodiments are not to be restricted except in light of the attached claims and their equivalents. Also, various modifications and changes may be made within the scope of the attached claims.

What is claimed is:

1. An engine comprising:

a crankshaft connected to at least one piston by a connecting rod, the crankshaft configured to rotate about a crankshaft axis;

the crankshaft including a first axial portion that lies on the crankshaft axis and is substantially symmetric about the crankshaft axis;

the crankshaft including a crankshaft journal having a first journal side wall connected to a second journal side wall by a crankpin member radially offset from the crankshaft axis;

the first journal side wall disposed axially between the first axial portion and the crankpin member and extending radially away from the crankshaft axis and beyond the first axial portion so as to define an axial facing surface facing in a direction substantially parallel to the crankshaft axis and toward the first axial portion;

a timing plate having a central hole and a plurality of indicia on a periphery portion of the timing plate;

the timing plate including at least one protruding portion extending in the direction substantially parallel to the crankshaft axis and toward the axial facing surface of the first journal side wall;

wherein the timing plate defines a first hole through the timing plate in a direction substantially parallel to the crankshaft axis;

wherein the timing plate defines a second hole through the timing plate in a direction substantially parallel to the crankshaft axis;

wherein the first hole and the second hole are adjacent to each other so as to define the at least one protruding portion as an elongated member between the first hole and the second hole;

wherein the first hole extends radially to define a first radial side of the elongated member;

wherein the second hole extends radially to define a second radial side of the elongated member;

wherein a radial length of the first and second radial sides of the elongated member is greater than a distance between the first and second radial sides in an angular direction;

wherein the elongated member is bent so as to protrude from a first axial facing surface of the timing plate;

wherein the first axial portion of the crankshaft extends through the central hole of the timing plate;

wherein the axial facing surface of the first journal side wall of the crankshaft defines at least one receiving portion configured to receive the at least one protruding portion; and wherein the timing plate is configured to move along the crankshaft axis.

2. The engine according to claim 1, wherein the timing plate and the crankshaft rotate with substantially the same speed when the at least one receiving portion engages the at least one protruding portion.

3. The engine according to claim 1, wherein the timing plate floats about the first axial portion when the timing plate and the crankshaft rotate.

4. The engine according to claim 1, wherein the at least one receiving portion is a cavity in the axial facing surface of the first journal side wall of the crankshaft.

5. The engine according to claim 1, wherein the first axial portion of the crankshaft is a main bearing journal.

6. The engine according to claim 1, wherein the elongated member comprises a first elongated member;

wherein the timing plate defines a third hole through the timing plate in a direction substantially parallel to the crankshaft axis;

wherein the timing plate defines a fourth hole through the timing plate in a direction substantially parallel to the crankshaft axis;

wherein the third hole and the fourth hole are adjacent to each other so as to define a second elongated member between the third hole and the fourth hole;

wherein the third hole extends radially to define a first radial side of the second elongated member;

wherein the fourth hole extends radially to define a second radial side of the second elongated member;

wherein a radial length of the first and second radial sides of the second elongated member is greater than a distance between the first and second radial sides of the second elongated member in an angular direction;

wherein the second elongated member is bent so as to protrude from the first axial facing surface of the timing plate; and wherein the second elongated member is angularly offset from the first elongated member at an obtuse angle.

7. The engine according to claim 1, wherein the timing plate has a second axial facing surface opposite to the first axial facing surface; and wherein the second axial facing surface of the timing plate comprises a first thrust surface raised from a remainder of the second axial facing surface a distance in the direction substantially parallel to the crankshaft axis.

8. The engine according to claim 7, further comprising:

a bearing having a second thrust surface;

wherein the first axial portion of the crankshaft is a bearing journal;

wherein the bearing is disposed along the bearing journal on a side of the timing plate opposite to the first journal side wall;

wherein the bearing holds the bearing journal and enables the bearing journal to rotate against the bearing about the crankshaft axis;

wherein when the at least one protruding portion is engaged with the at least one receiving portion the timing plate rotates with the crankshaft and moves axially to and fro between the bearing and the first journal side wall; and wherein the second thrust surface of the bearing contacts the first thrust surface of the timing plate.

9. The engine according to claim 7, wherein the first thrust surface is a ring shaped surface located radially between the central hole and the plurality of indicia.

10. An engine comprising:

a crankshaft connected to at least one piston via a connecting rod, the crankshaft being configured to rotate about a crankshaft axis; and a timing plate having a central hole and a plurality of indicia on a periphery portion of the timing plate, wherein:

the crankshaft includes a first axial component that lies on the crankshaft axis and is substantially symmetric about the crankshaft axis, the crankshaft includes a crankshaft journal having a first journal side wall connected to a second journal side wall by a crankpin member radially offset from the crankshaft axis, the first journal side wall is disposed axially between the first axial component and the crankpin member, extends radially beyond the first axial component, and has an axial facing surface facing in a direction toward the first axial component, the first axial component of the crankshaft extends through the central hole of the timing plate, the timing plate includes a first protruding portion and a second protruding portion each extending in a direction substantially parallel to the crankshaft axis and toward the axial facing surface of the first journal side wall, the timing plate defines a first hole through the timing plate in a direction substantially parallel to the crankshaft axis, the timing plate defines a second hole through the timing plate in a direction substantially parallel to the crankshaft axis, the first hole and the second hole are adjacent to each other so as to define the first protruding portion as an elongated member between the first hole and the second hole, the first hole extends radially to define a first radial side of the elongated member, the second hole extends radially to define a second radial side of the elongated member, a radial length of the first and second radial sides of the elongated member is greater than a distance between the first and second radial sides in an angular direction, the elongated member is bent so as to protrude from a first axial facing surface of the timing plate, the first protruding portion and the second protruding portion are angularly offset from each other at an obtuse angle, the axial facing surface of the first journal side wall of the crankshaft defines a first receiving portion and a second receiving portion each removably mated with the first protruding portion and the second protruding portion respectively, the timing plate and the crankshaft rotate with substantially the same speed, and the timing plate floats about the first axial component when the timing plate and the crankshaft rotate.

11. The engine according to claim 10, wherein the first receiving portion is a cavity in the axial facing surface of the first journal side wall of the crankshaft;

wherein the cavity has a radial dimension;

wherein the first protruding portion has a radial length disposed in the cavity; and wherein the radial length of the first protruding portion is less than half the radial dimension of the cavity to allow the first protruding portion to move within the cavity and to allow adjustment of a position of the timing plate relative to the first axial component of the crankshaft.

12. The engine according to claim 10, wherein the first protruding portion and the second protruding portion protrude from the first axial facing surface of the timing plate;

wherein the timing plate has a second axial facing surface opposite to the first axial facing surface; and wherein the second axial facing surface of the timing plate comprises a first thrust surface raised from a remainder of the second axial facing surface.

13. The engine according to claim 12, further comprising:

a bearing having a second thrust surface;

wherein the first axial portion of the crankshaft is a bearing journal;

wherein the bearing is disposed along the bearing journal on a side of the timing plate opposite to the first journal side wall;

wherein the bearing holds the bearing journal and enables the bearing journal to rotate against the bearing about the crankshaft axis;

wherein when the first protruding portion and the second protruding portion are engaged with the first receiving portion and the second receiving portion respectively, the timing plate rotates with the crankshaft and moves axially to and fro between the bearing and the first journal side wall; and wherein the second thrust surface of the bearing contacts the thrust surface of the timing plate.

14. The engine according to claim 12, wherein the first thrust surface is a ring shaped surface located radially between the central hole and the plurality of indicia.

15. An engine comprising:

a crankshaft connected to at least one piston via a connecting rod, the crankshaft being configured to rotate about a crankshaft axis; and a timing plate having a central hole and a plurality of indicia, wherein:

the crankshaft defines a cylindrical surface around the crankshaft axis, the crankshaft includes a crankshaft journal having a first journal side wall connected to a second journal side wall by a member extending parallel to and radially offset from the crankshaft axis, the first journal side wall is disposed between the cylindrical surface and the member and has a first mating surface extending radially away from the crankshaft axis and generally perpendicular to the cylindrical surface, the timing plate has a second mating surface facing the first mating surface of the first journal side wall, the timing plate has a protruding portion protruding from the second mating surface in a direction substantially parallel to the crankshaft axis, the timing plate defines a first oblong hole through the timing plate in a direction substantially parallel to the crankshaft axis, the timing plate defines a second oblong hole through the timing plate in a direction substantially parallel to the crankshaft axis, the first oblong hole and the second oblong hole are adjacent to each other so as to define the protruding portion between the first oblong hole and the second oblong hole the first oblong hole extends radially to define a first radial side of the protruding portion, the second oblong hole extends radially to define a second radial side of the protruding portion, a radial length of the first and second radial sides of the protruding portion is greater than a distance between the first and second radial sides in an angular direction, the protruding portion is bent so as to protrude from the second mating surface of the timing plate, the first journal side wall of the crankshaft has a receiving portion in the first mating surface, the protruding portion of the timing plate is disposed in the receiving portion of the first journal side wall of the crankshaft, and the timing plate and the crankshaft rotate with substantially the same speed, and the timing plate is associated with the crankshaft via a connecting system, the connecting system consisting essentially of the protruding portion being received by the receiving portion.

16. The engine according to claim 15, wherein:

the crankshaft has a first axial portion that lies on the crankshaft axis and is substantially symmetric about the crankshaft axis, the first axial portion of the crankshaft extends through the central hole of the timing plate, and the timing plate floats about the first axial portion when the timing plate and the crankshaft rotate.

17. The engine according to claim 15, wherein the receiving portion is a cavity in the first mating surface of the first journal side wall of the crankshaft, wherein a length of the protruding portion in a radial direction is approximately 70% of a length of an opening of the cavity in a radial direction such that the timing plate adjustably moves relative to the crankshaft in a direction perpendicular to the crankshaft axis.

18. The engine according to claim 16, wherein the timing plate has a thrust bearing side surface on a side of the timing plate opposite to the second mating surface of the timing plate; and wherein the thrust bearing side surface of the timing plate comprises a first thrust surface raised from a remainder of the thrust bearing side surface.

19. The engine according to claim 18, further comprising:

a bearing having a second thrust surface;

wherein the first axial portion of the crankshaft is a bearing journal;

wherein the bearing is disposed along the bearing journal on a side of the timing plate opposite to the first journal side wall;

wherein the bearing holds the bearing journal and enables the bearing journal to rotate against the bearing about the crankshaft axis;

wherein when the protruding portion is engaged with the receiving portion the timing plate rotates with the crankshaft and moves axially to and fro between the bearing and the first journal side wall; and wherein the second thrust surface of the bearing contacts the first thrust surface of the timing plate.

20. The engine according to claim 18, wherein the first thrust surface is a ring shaped surface located radially between the central hole and the plurality of indicia.

21. The engine according to claim 1, wherein the at least one protruding portion is disposed on the timing plate radially spaced apart from the central hole; and wherein the at least one receiving portion is disposed on the axial facing surface of the first journal side wall radially spaced apart from the first axial portion.

22. The engine according to claim 1, wherein the timing plate has a second axial facing surface opposite to the first axial facing surface;

wherein the at least one receiving portion is a rectangular prism shaped cavity; and wherein the first axial facing surface contacts the axial facing surface of the first journal side wall of the crankshaft along a plane perpendicular to the crankshaft axis when the at least one receiving portion receives the at least one protruding portion.

23. The engine according to claim 1, wherein when the timing plate is viewed in a radial cross-section:

the timing plate comprises an inner circular portion adjacent to the central hole, an outer circular portion including the periphery portion, and a middle circular portion radially between the inner circular portion and the outer circular portion;

the inner circular portion and the outer circular portion are coplanar in a plane; and the middle circular portion comprises the elongated member protruding from the plane in a semi-circular cross-sectional shape.

24. The engine according to claim 1, wherein a length of a protruding portion of the elongated member in a radial direction is approximately 70% of a length of an opening of the at least one receiving portion in a radial direction such that the timing plate adjustably moves relative to the first journal side wall in a direction radial to the crankshaft axis.

* * * * *